US010234091B1

(12) United States Patent
Chaimberg et al.

(10) Patent No.: US 10,234,091 B1
(45) Date of Patent: Mar. 19, 2019

(54) CEILING MOUNTABLE LED LIGHT FIXTURE WITH ACCESSIBLE CCT SELECTABLE SWITCH

(71) Applicant: Adam Chaimberg, Hampstead (CA)

(72) Inventors: Adam Chaimberg, Hampstead (CA); Xianwen Xiong, Lin'an Hang Zhou (CN)

(73) Assignee: Adam Chaimberg, Hampstead, QC (CA)

( * ) Notice: Subject to any disclaimer, the term of this patent is extended or adjusted under 35 U.S.C. 154(b) by 0 days.

(21) Appl. No.: 15/932,801

(22) Filed: Apr. 27, 2018

(30) Foreign Application Priority Data

Mar. 26, 2018 (CA) ..... 2999308

(51) Int. Cl.

| | |
|---|---|
| ***F21S 8/04*** | (2006.01) |
| ***F21V 23/00*** | (2015.01) |
| ***F21V 17/16*** | (2006.01) |
| ***F21V 23/04*** | (2006.01) |
| *F21Y 105/10* | (2016.01) |
| *F21Y 115/10* | (2016.01) |

(52) U.S. Cl.
CPC ..... *F21S 8/043* (2013.01); *F21V 17/162* (2013.01); *F21V 23/001* (2013.01); *F21V 23/008* (2013.01); *F21V 23/04* (2013.01); *F21Y 2105/10* (2016.08); *F21Y 2115/10* (2016.08)

(58) Field of Classification Search
CPC ..... F21S 8/043; F21V 23/04; F21V 17/162; F21V 23/001; F21V 23/008
See application file for complete search history.

(56) References Cited

U.S. PATENT DOCUMENTS

| | | | | |
|---|---|---|---|---|
| 9,388,969 | B2 * | 7/2016 | Doubek | F21V 17/164 |
| 9,651,209 | B2 * | 5/2017 | Demuynck | H05B 33/0803 |
| 2008/0079906 | A1 * | 4/2008 | Finn | F21S 2/005 353/53 |
| 2014/0226316 | A1 * | 8/2014 | Medendorp, Jr. | F21S 8/043 362/147 |
| 2016/0290614 | A1 * | 10/2016 | Badley | F21V 19/00 |

* cited by examiner

*Primary Examiner* — Joseph L Williams
(74) *Attorney, Agent, or Firm* — Guy J. Houle; Houle Patent Agency Inc.

(57) ABSTRACT

A ceiling mountable LED light fixture is described and wherein at least two sets of LED's of different correlated color temperatures (CCT) are mounted in its housing. The LED light fixture is adapted to be removably secured in a housing mounting hole in a ceiling sheeting material. A cable is secured to the light fixture to supply drive current to the LED sets. A toggle switch is mounted in the cable in close proximity to the light fixture. The cable also has a predetermined length and is also secured at a far end to a driver circuit mounted in a driver housing. The driver housing is positioned behind the ceiling sheeting material spaced from the housing mounting hole. The toggle switch is made accessible and visible by simply withdrawing the light fixture from its mounting hole and by displacing a slide switch button to select one of three positions to energize a selected one of both sets of LED's or both sets of LED's simultaneously whereby to cause the LED light fixture to generate one of three different color temperature (CCT) light.

10 Claims, 2 Drawing Sheets

CEILING MOUNTABLE LED LIGHT FIXTURE WITH ACCESSIBLE CCT SELECTABLE SWITCH

FIELD OF THE INVENTION

The present invention relates to light emitting diode (LED) light fixtures and more specifically to a ceiling mountable LED light fixture having at least two sets of LED's of different correlated color temperature (CCT) and wherein a selector switch is mounted in a cable secured to the LED light fixture and which is readily accessible when the LED light fixture is removed from its ceiling mounting hole.

BACKGROUND OF THE INVENTION

With incandescent lights the current fed through its filament produces heat and light. The temperature of the filament determines the color of the light. When the temperature is low, a yellowish light is produced and as the temperature increases the light becomes whiter, like daylight. With LED's, which are semiconductor devices, they are driven by direct current and the brightness is proportional to the current flowing through the LED. Accordingly, the intensity of the LED can be controlled by controlling the amount of current fed to the LED and this is commonly controlled by a dimmer switch.

The color of light is determined in terms of color temperature expressed in Kelvin degrees. For example, sunlight in the summer is equivalent to about 5400 Kelvin temperature, warm white light is equivalent to about 3000 Kelvin temperature and light resembling a flame is equivalent to about 1700 Kelvin temperature. Accordingly, it is desirable to control the current to create a warm and cozy environment which is more relaxing than bright sunlight. It is known to mix white LED's with amber LED's and control their current to mix the color of the light generated by the combination to produce a change in the color of the light. When using different color LED's, it is common to use a driver circuit for each of the LED's or a driver with separate output channels.

Some LED light fixtures with two or more sets of color LED's, for installation in ceilings, are provided with a driver housing which is usually positioned resting on the rear surface of the ceiling sheeting with a long feed wire loose over the rear surface of the sheeting material. A switch is mounted on the driver housing to select a desired color temperature of the LED light fixture. To change the switch setting it is necessary to retract the housing by pulling the light fixture to position the driver housing adjacent the mounting hole and then with the hand to manipulate the driver housing, which is not visible, to be able to pull it out of the hole. Because the housings of LED light fixture are of different diameter sizes the fixture mounting hole may be too small to provide easy access to the drive housing and to manipulate the housing to retract it from the fixture mounting hole. This is not a task that is suitable for many people and damage can be caused to the ceiling sheeting material about the mounting hole. Still further, there is a hazard presented by the live wire connected to the driver circuit inside the driver housing, particularly if there is a fault in the wiring. There is also a hazard of working on a ladder to be close to the ceiling to remove the diver housing from the fixture mounting hole. Manipulating the driver housing is therefore not recommended for safety reasons.

In a situation where the driver housing is immovably secured to a rigid structural member at a desired location where the ceiling fixture is to be secured further problems are presented. In such an installation the user person must select the light mood desired at the time of installation has access to the switch may not be possible as it would not be visible. Also, as pointed out above, after the ceiling construction is complete the mounting hole may be too small to provide access to the driver housing. This creates a problem if the end user desires to later change the color of the light generated by the LED light fixture and such would require the skill of an electrician to do so and repair to the ceiling sheeting material, if damaged in the process.

SUMMARY OF THE INVENTION

It is a feature of the present invention to overcome the above mentioned problems and disadvantages by providing an LED light fixture wherein the selector switch is readily available and visible to the end user by simply removing the light fixture which draws only the selector switch out of the fixture mounting hole.

According to the above feature, from a broad aspect, the present invention provides a ceiling mountable LED light fixture which is comprised of an LED light housing. At least two sets of LED's are mounted in the housing for generating light at different correlated color temperature (CCT). A driver housing having a driver circuit is mounted therein is also provided. The driver housing is adapted for mounting behind a ceiling sheet material and spaced from a fixture mounting hole formed in the ceiling sheet material. A cable interconnects the driver circuit in the driver housing to the LED light housing for supplying output current from the driver circuit to the at least two sets of LED's. The light fixture has an outer circumferential flange, and detachable retention means is secured to the LED light housing for removable securement of the LED light fixture in the fixture mounting hole with the circumferential flange in abutment against an outer surface of the ceiling sheet material about the fixture mounting hole. The cable has a predetermined length to permit the LED light fixture to be withdrawn from the fixture mounting hole a predetermined distance to provide access to a selector switch mounted in the cable to permit selective activation of either one of the at least two sets of LED's or both sets of LED's simultaneously to cause the LED light fixture to generate light at a selected desired correlated color temperature (CCT).

BRIEF DESCRIPTION OF THE DRAWINGS

A preferred embodiment of the present invention will now be described with reference to the accompanying drawings in which.

DESCRIPTION OF THE PREFERRED EMBODIMENT

Figure 1:
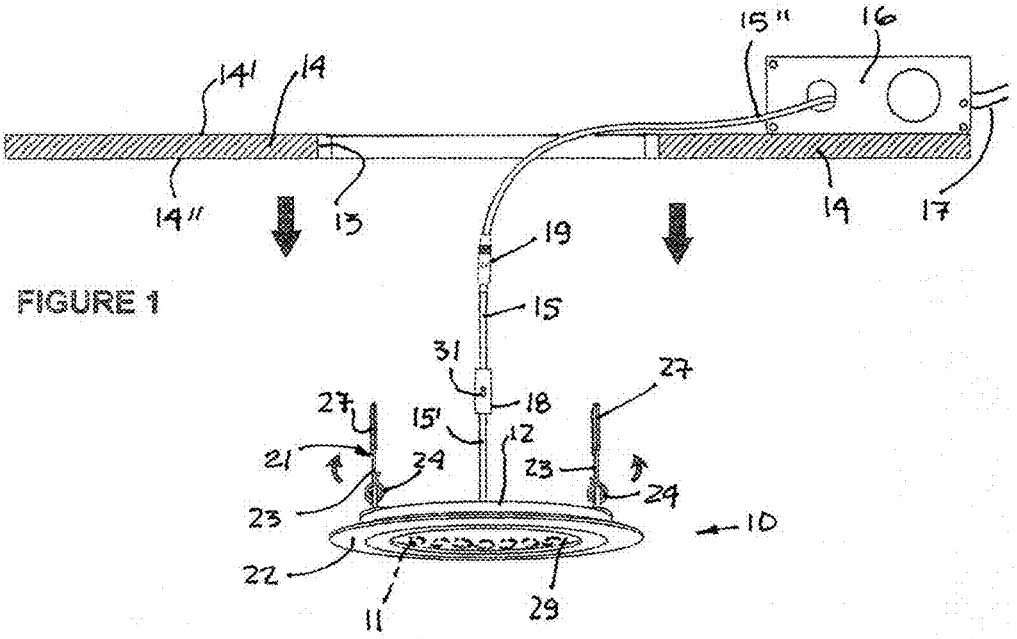
FIG. 1 is a perspective view showing the LED light fixture of the present invention removed from its fixture mounting hole in a ceiling and with the selector switch secured to a cable which is out of the mounting hole and visually accessible for operating the selector switch and showing the driver housing located behind the ceiling sheet material at a non-visible location.
Figure 2:
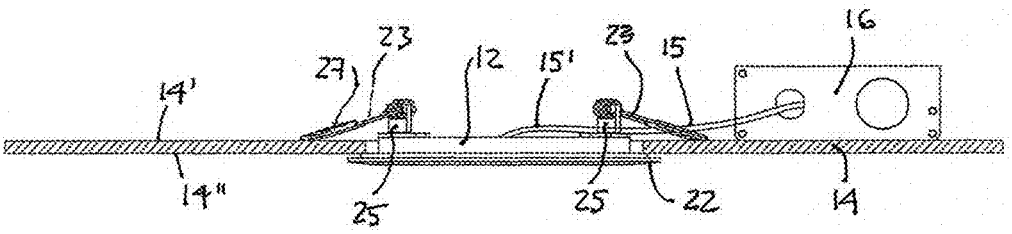
FIG. 2 is a side view, partly fragmented showing the LED light fixture of the present invention mounted in the fixture mounting hole of the ceiling sheet material.

Referring to the drawings, and more specifically to FIGS. 1 and 2, there is shown a ceiling mountable LED light fixture 10 which has mounted therein two sets of different color light emitting diodes (LED's) 11, shown in phantom lines. The LED's 11 are mounted in a suitable manner, such as in alternation inside a wall of the housing 12 of the light fixture 10. The LED's have different Kelvin temperature ratings (CCT) and in this embodiment a first set of LED's generate a Kelvin temperature of 5000 K, which is white light and the second set generates a Kelvin temperature of 3000 K, which is warm amber light. It is pointed out that other combinations of color LED's can be incorporated in the LED light fixture housing 12 depending on the color characteristics that one desires to be produced by the LED light fixture.

Figure 3:
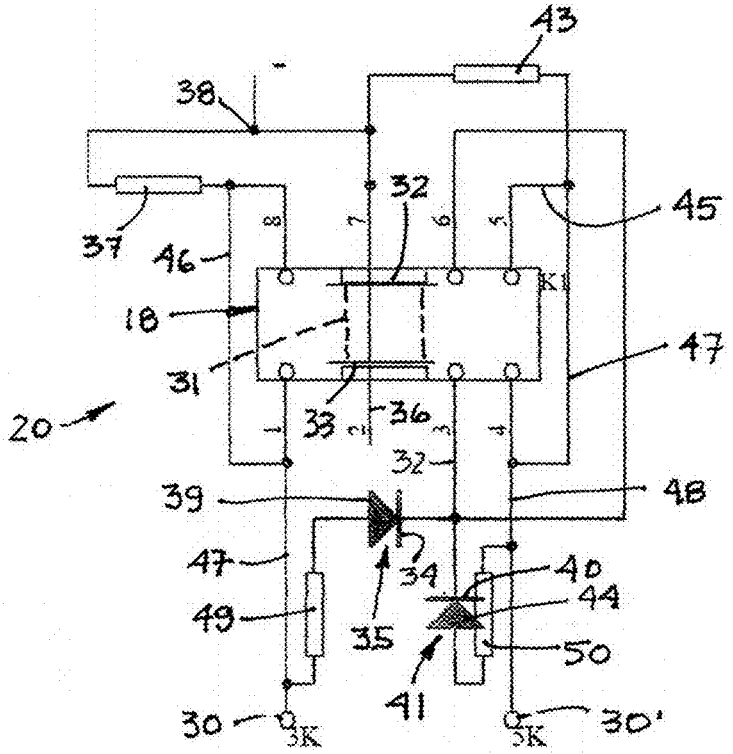
FIG. 3 is a schematic diagram of the driver circuit.

As shown in FIG. 1, the LED light fixture 10 is shown retracted from its fixture mounting hole 13 formed in the ceiling sheeting material 14, herein gypsum board, but it could also be a wood board or other type of sheeting material. As shown, a cable 15 is secured at one end 15', to the light housing 12 and has wires therein secured to the two sets of LED's to supply driving current to each of the sets and such is obvious to a person skilled in the art. The cable 15 is also secured at a far end 15" to a driver circuit 20 as illustrated in FIG. 3. The driver circuit 20 is mounted in a driver housing 16 to which is supplied line voltage from live wire 17. The driver housing can be secured to ceiling structural members not shown, before the installation of the sheeting material 14 or be conveniently located over the top surface 14' of the ceiling sheeting 14 through the mounting hole after the ceiling sheeting material is installed. Usually, a selector switch is mounted on the driver housing 16 to select a desired color temperature to be emitted by the light fixture and this is done by pulling the housing 16 out from the fixture mounting hole 13 and operating the switch to a desired switch setting to change the color temperature of the LED's to a different one. Accordingly, a long live wire 17 has to be provided and by repeatedly changing the setting of such a switch, damage can be caused to the periphery of the fixture mounting hole 13. There is also the risk that damage can be caused to the live wire 17 by repeated manipulation and not to mention the risk of electrical shocks. If the driver housing 16 is immovably secured, such as to a joist adjacent the hole, one has to insert its arm through the mounting hole 13 and try and locate the housing and the switch mounted thereto, that is if the mounting hole is large enough to insert the arm of a person. In such installation it is best to preset the switch to a desired position before the ceiling sheeting material is installed and to leave it at that set position.

As shown in FIG. 1, with the present invention the selector switch 18 is mounted on the cable 15 adjacent to the LED light fixture housing 12 and the cable is of suitable length to provide access to the switch 18 without having to withdraw the driver housing 16 from the fixture mounting hole 13. A connector 19 is herein shown secured to the cable 15 for disconnecting the cable lower end section 15' and the switch from the driver housing 16 should replacement of the LED light fixture be necessary for all sorts of reasons, such as changing the fixture to one having different colored LED's or to replace the light transmitting lens 29 or for any repair.

As illustrated in FIGS. 1 and 2, the LED light fixture 10 is provided with detachable retention means 21 secured to the light housing 12 for removable securement of the LED light housing 10 in the fixture mounting hole whereby the external circumferential flange 22 of the housing 12 will be maintained in abutment against the outer surface 14" of the ceiling sheeting material 14 and about the fixture mounting hole 13. These figures illustrate one form of detachable retention means but many other attachments are contemplated for such use.

The detachable retention means 21 herein illustrated is comprised of two clamping arms 23 secured to the housing 12 on opposed diagonal sides of the housing and are spring biased to a downward and inwardly inclined position as illustrated in FIG. 2. The arms 23 form part of a coil spring 24 secured on a support vertical flange 25 immovably mounted on the top wall 26 of the housing 12. In its position of rest, the arms 23 are biased downwards as shown in FIG. 2. The outer section of the arms 23 are covered with a protective material sleeve 27 not to damage the inner surface 14' of the sheeting material which is usually gypsum covered with a paper liner.

To install the LED light fixture 10 in the mounting hole 13 it is necessary to hold the spring biased arms 21 upright, as shown in FIG. 1, and to place the LED light fixture 10 into the mounting hole 13 and to release the arms 23 once part of the arms is in the hole 13. The fixture 10 is then pushed in the hole with the arms 23 drawing the fixture inwards by the sprig pulling force of the arms with their outer section now in abutment against the inner surface 14' of the ceiling sheeting material 14 drawing the flange 22 against to outer surface 14" of the ceiling sheeting material 14. To withdraw the LED light fixture 10 it is necessary to pull on the flange 22 to remove the LED light fixture and part of the cable 15 to provide easy and visual access to the switch 18 and the connector 19.

With reference now to FIG. 3 there will be described the operation of the driver circuit 20 which is mounted in the driver housing 16. The driver circuit 20 drives either of the LED sets schematically represented at 30 for the 3000 Kelvin set and at 30' for the 5000 Kelvin set. The switch 18 is a toggle switch provided with a slide button 31 having two conducting arms 32 and 33 and displaceable to three switch positions. At a first position, the contacts 8 and 7, as well as contacts 1 and 2, are bridged by conductor arms 32 and 33, respectively. At this position the driver current at contact 1 is bridged to contact 2 to which the anode 34 of the driver diode 35 is connected through conductor 36. The current at contact 1 has been reduced by resistance 37 to a value to enable the diode 35 to conduct. The resistance 37 is provided to lower the input current at terminal 38 to prevent a high current impact on the leads of the 3000 Kelvin LED's 30, which could burn the LED's. When the diode 35 conducts, the driver current at its cathode 39 completes the current supply circuit to drive the 3000 K (CCT) diode set 30.

When the slide button 31 is moved to the right side to a second position, the contacts 6 and 5, as well as contacts 3 and 4 are bridged by conductor arms 32 and 33, respectively. At this position the driver current at contact 4 is bridged to contact 3 which is connected to the anode 40 of the diode 41 through conductor 42. The resistance 37 lowers the input current at terminal 38 to prevent a high current impact on the leads of the 5000 K LED's. The cathode 44 of driver diode 41 is connected to the supply current at contact 4 to complete the current supply circuit to drive the 5000 K (CCT) LED diode set 30'.

When the slide button 31 is positioned to the middle, at a third position of the switch, contacts 7 and 6, as well as contacts 2 and 3 are bridged by conductor arms 32 and 33, respectively. At this position the driver current at contact 7 is bridged to contact 5 and to the anodes 34 and 40 of the driver diodes 35 and 41, respectively, through conductors 45, 47 and 48. The cathode 39 of the driver diode 35 is connected to the terminal 38 through resistance 37 and conductors 46 and 47. The cathode 44 of the driver diode 41 is connected to the terminal 38 via resistance 43 and conductors 47 and 48. Accordingly, both of the driver diodes 35 and 41 are in their conductive state to supply drive current to both sets of LED' 30 and 30'. Resistances 49 and 50 are connected in the circuit to equally distribute the current to the LED sets 30 and 30'. When the combination of the two LED sets 30 and 30' are supplied drive current, the luminance generated by the two sets produces a light color of the order of 4000 Kelvin (CCT).

It is within the ambit of the present invention to cover all obvious modifications of the preferred embodiment described herein, provided such modifications fall within the scope of the appended claims.

The invention claimed is:

1. A ceiling mountable LED light fixture comprising an LED light housing, at least two sets of LED's mounted in said housing for generating light at different correlated color temperature (CCT), a driver housing having a driver circuit mounted therein, said driver housing being adapted for mounting behind a ceiling sheet material and spaced from a fixture mounting hole formed in said ceiling sheet material, a cable interconnecting said driver circuit in said driver housing to said LED light housing for supplying output current from said driver circuit to said at least two sets of LED's, said light fixture having an outer circumferential flange, detachable retention means secured to said LED light housing for removable securement of said LED light fixture in said fixture mounting hole with said circumferential flange in abutment against and outer surface of said ceiling sheet material about said fixture mounting hole, said cable having a predetermined length to permit said LED light fixture to be withdrawn from said fixture mounting hole a predetermined distance to provide access to a selector switch mounted in said cable to permit selective activation of either one of said at least two sets of LED's or both sets of LED's simultaneously to cause said LED light fixture to generate light at a selected desired correlated color temperature (CCT).

2. A ceiling mountable LED light fixture as claimed in claim 1 wherein said selector switch has three switch positions, a first switch opposition wherein output current is supplied only to a first of said at least two sets of LED's, a second position wherein output current is supplied only to a second of said at least two sets of LED's, and a third position wherein output current is equally distributed to a combination of said first and second sets of said at least two sets of LED's.

3. A ceiling mountable LED light fixture as claimed in claim 2 wherein said first set of LED's generate light at 3000 Kelvin temperature (CCT), said second set of LED's generate light at 5000 Kelvin temperature (CCT), and said combination of said second and third set of LED's generate combined light at 4000 Kelvin temperature (CCT).

4. A ceiling mountable LED light fixture as claimed in claim 1 wherein said driver housing is immovably secured behind said ceiling sheet material spaced from said fixture mounting hole.

5. A ceiling mountable LED light fixture as claimed in claim 1 wherein said selector switch is secured to said cable in close proximity to said LED light housing to provide ease of access to said switch by withdrawing said LED light fixture and part of said cable from said fixture mounting hole, said cable being comprised of wiring interconnecting said switch to said driver circuit and wiring interconnecting said switch to said at least two sets of LED's.

6. A ceiling mountable LED light fixture as claimed in claim 1 wherein said detachable retention means is provided by at least two spring biased clamping arms secured spaced apart to a rear portion of said LED light housing, said clamping arms maintaining said circumferential flange against an outer surface of said ceiling sheet material about said fixture mounting hole.

7. A ceiling mountable LED light fixture as claimed in claim 6 wherein said at least two spring biased clamping arms are secured spaced apart to a rear wall of said LED light housing and spring biased from an upright position to a downward and inwardly inclined position, said arms being dimensioned for clamping engagement against a rear surface of said ceiling sheet material adjacent said fixture mounting hole, said clamping arms exerting a pulling force on said circumferential flange, said LED light housing when withdrawn from said fixture mounting hole causing said spring biased clamping arms to retract towards said upright position.

8. A ceiling mountable LED light fixture as claimed in claim 1 wherein there is further provided a connector secured to said cable between said selector switch and said driver housing in close proximity to said selector switch to permit disconnection of a section of said cable to which said LED light fixture and said selector switch are secured.

9. A ceiling mountable LED light fixture as claimed in claim 1 wherein a light transmitting lens is retained across an outer surface of said LED light housing and surrounded by said circumferential flange.

10. A ceiling mountable LED light fixture as claimed in claim 2 wherein selector switch is a toggle switch, a slide button secured to a casing of said toggle switch to displace conducting arms to said first, second and third positions.

* * * * *